US005627333A

United States Patent [19]

Stahnke et al.

[11] Patent Number: 5,627,333

[45] Date of Patent: May 6, 1997

[54] KEYBOARD MUSICAL INSTRUMENT EQUIPPED WITH BUILT-IN DISTANCE MEASURING INSTRUMENT FOR HAMMER SENSORS

[75] Inventors: Wayne L. Stahnke, Los Angeles, Calif.; Yuji Fujiwara, Shizuoka, Japan; Taro Kawabata, Shizuoka, Japan; Rei Furukawa, Shizuoka, Japan; Takashi Tamaki, Shizuoka, Japan

[73] Assignee: Yamaha Corporation, Japan

[21] Appl. No.: 654,563

[22] Filed: May 29, 1996

[51] Int. Cl.[6] ..... G10G 3/04

[52] U.S. Cl. ..... 84/462; 84/171

[58] Field of Search ..... 84/461, 462, 171, 84/170

[56] References Cited

U.S. PATENT DOCUMENTS 4,913,026 4/1990 Kaneko et al. ..... 84/21

5,291,011 3/1994 Mantani ..... 250/208.3

*Primary Examiner*—Michael L. Gellner

*Assistant Examiner*—Shih-yung Hsieh

*Attorney, Agent, or Firm*—Graham & James LLP

[57] ABSTRACT

A hammer sensor incorporated in a keyboard musical instrument monitors a motion of each hammer assembly, and a controller not only determines a hammer velocity and an impact time for generating a set of music data codes representative of a music performance but also measures an actual distance between the hammer sensor and an impact point against a music string on the basis of a forward trajectory and a backward trajectory measured by the hammer sensor; thereby allowing a worker to easily adjust the hammer sensor to an appropriate position.

10 Claims, 7 Drawing Sheets

KEYBOARD MUSICAL INSTRUMENT EQUIPPED WITH BUILT-IN DISTANCE MEASURING INSTRUMENT FOR HAMMER SENSORS

FIELD OF THE INVENTION

This invention relates to a keyboard musical instrument and, more particularly, to a keyboard musical instrument equipped with a built-in distance measuring instrument for adjusting hammer sensors to appropriate positions.

DESCRIPTION OF THE RELATED ART

An automatic player piano is a kind of the keyboard musical instrument equipped with hammer sensors, and the hammer sensor monitors a hammer motion. In order to reproduce a music, the automatic player piano requires data information representative of an impact of a hammer against strings and an impact timing against the strings. For this reason, the automatic player piano is equipped with hammer sensors for monitoring the hammer motions.

A typical example of the hammer sensor is implemented by two photo-interrupters spaced apart by a predetermined distance, and the two photo-interrupters radiate light beams across a path of the hammer assembly. When a player depresses a key, the key action mechanism transfers the force exerted on the key to the hammer assembly, and the hammer assembly starts the rotation toward the strings. While the hammer assembly is traveling along the path, the light beam of one of the photo-interrupters is firstly intersected by the hammer assembly, and the light beam of the other photo-interrupter is, thereafter, intersected by the hammer assembly. The time interval between the first intersection and the second intersection is measured, and the hammer velocity is calculated on the basis of the time interval and the distance between the two photo-interrupters. The hammer velocity is proportional to the impact of the hammer or a hammer impact, and the automatic player piano generates a music data code representative of the hammer impact on the basis of the hammer velocity.

The second photo-interrupter is placed at a position as close to a rebounding point of the hammer assembly, and the automatic player piano assumes the intersection of the second light beam to be the impact of hammer or an impact point. The automatic player piano generates a music data code representative of the impact timing on the basis of the second intersection.

While the automatic player piano is reproducing the music, the automatic player piano forecasts an initiative timing for a key motion on the basis of the music data code representative of the hammer impact and the music data code representative of the impact timing. The automatic player piano energizes a solenoid-operated actuator unit associated with the key at the initiative timing so as to start the key downwardly.

As described hereinbefore, the impact timing is determined by using the second photo-interrupter. If the second interrupters are exactly positions at the impact points, respectively, the hammer assemblies generate the tones at intervals exactly identical with the those in the original performance. However, if several second photo-interrupters deviate from the appropriate positions, the reproduced performance is slightly different from the original performance. The dispersion becomes clear in a chord and softly depressed keys.

As will be understood, it is necessary for the second photo-interrupters to be positioned. The manufacturer adjusts the second photo-interrupters by using two kinds of clearance gauge. A tuning worker puts the clearance gauge on a set of strings, and brings the associated hammer in contact with the clearance gauge. The tuning worker regulates the second photo-interrupter in such a manner that the hammer assembly intersects the light beam of the second photo-interrupter.

In another tuning work, a tuning worker measures a distance between the hammer position at the impact point and the hammer position at the intersection of the second photo-interrupter by using a laser beam, and adjusts the distance to a predetermined value. The tuning worker attaches the laser displacement gauge to the hammer assembly and, thereafter, disassembled from it, because the laser displacement gauge is too expensive to be permanently installed in the automatic player piano.

A gray scale is attached to a hammer assembly, and rotates the hammer assembly. The associated second photo-interrupter reads the gray scale, and a tuning worker regulates the second photo-interrupter to an appropriate position.

Thus, the tuning worker individually adjusts the second photo-interrupters to the appropriate positions before the delivery from the factory, and the tuning work consumes large amount of time and labor. This is the first problem inherent in the prior art automatic player piano, The second problem is low reliability of the tuning work. A standard hammer assembly has a hammer head formed of felt, and the felt hammer head strikes the associated set of strings. The strings usually deforms the felt hammer head at the impact, and the deformation brings an error between the actual impact point and the expected impact point.

SUMMARY OF THE INVENTION

It is therefore an important object of the present invention to provide a keyboard musical instrument which exactly reproduces a performance represented by a set of music data codes.

To accomplish the object, the present invention proposes to calculate a distance between a second photo-interrupter and an impact point on the basis of a hammer position signal.

In accordance with one aspect of the present invention, there is provided a keyboard musical instrument comprising: an acoustic piano including a plurality of keys independently turnable on a stationary board member, a plurality of strings for generating tones through vibrations thereof, respectively, a plurality of hammer assemblies rotatable from respective rest positions for striking the plurality of strings at respective impact points, and a plurality of key action mechanisms respectively associated with the plurality of keys and respectively connected between the plurality of keys and the plurality of hammer assemblies for rotating the plurality of hammer assemblies when the plurality of keys are selectively moved; a plurality of hammer sensor units respectively associated with the plurality of hammer assemblies for monitoring the motions of the plurality of hammer assemblies, and each of the plurality of hammer sensor units including at least one first sensor provided at a first position and a second sensor provided at a second position closer to the impact point than the first position so as to change a hammer position signal when the associated hammer assembly passes through the first position and the second position; a controlling unit connected to the plurality of hammer sensor units for producing a set of music data codes representative of a music performance from the hammer position signals; and a distance measuring means including the plurality of hammer sensors and the controlling unit, and determining an actual distance between the second position to the impact point for each of the plurality of hammer sensor units on the basis of changes of the hammer position signal supplied from the aforesaid each of the plurality of hammer position units.

In accordance with another aspect of the present invention, there is provided a keyboard musical instrument comprising: an acoustic piano including a plurality of keys independently turnable on a stationary board member, a plurality of strings for generating tones through vibrations thereof, respectively, a plurality of hammer assemblies rotatable from respective rest positions for striking the plurality of strings at respective impact points, and a plurality of key action mechanisms respectively associated with the plurality of keys and respectively connected between the plurality of keys and the plurality of hammer assemblies for rotating the plurality of hammer assemblies when the plurality of keys are selectively moved; a plurality of hammer sensor units respectively associated with the plurality of hammer assemblies for monitoring the motions of the plurality of hammer assemblies, and each of the plurality of hammer sensor units including at least one first sensor provided at a first position and a second sensor provided at a second position closer to the impact point than the first position so as to change a hammer position signal when the associated hammer assembly passes through the first position and the second position; a controlling unit connected to the plurality of hammer sensor units for producing a set of music data codes representative of a music performance from the hammer position signals, the set of music data codes containing pieces of key-code information each indicative of one of the plurality of keys depressed or released, pieces of key velocity information each indicative of a hammer velocity between the first position and the second position and pieces of impact time information each indicative of an impact time at which an associated one of the plurality of hammer assemblies strikes the associated string; and a distance measuring means including the plurality of hammer sensors and the controlling unit, and determining an actual distance between the second position to the impact point for each of the plurality of hammer sensor units on the basis of changes of the hammer position signal supplied from the aforesaid each of the plurality of hammer position units, the controlling unit delaying a first time intersecting the second position by a second time calculated on the basis of the actual distance and a hammer velocity between the second position and the impact point for determining the impact time.

BRIEF DESCRIPTION OF THE DRAWINGS

The features and advantages of the key board musical instrument according to the present invention will be more clearly understood from the following description taken in conjunction with the accompanying drawings in which.

DESCRIPTION OF THE PREFERRED EMBODIMENTS

First Embodiment

Figure 1:
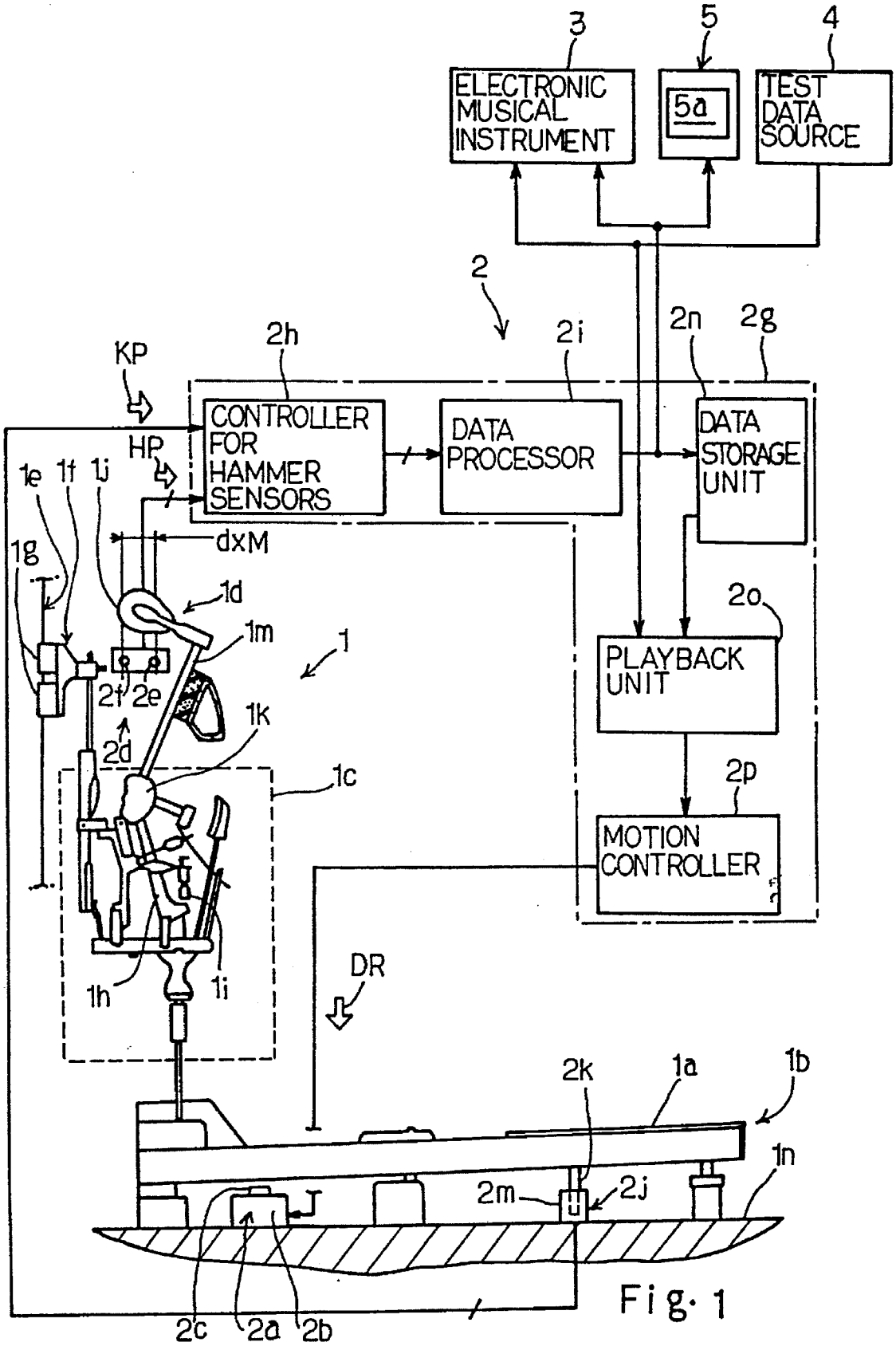
FIG. 1 is a schematic side view showing an automatic player piano according to the present invention.

Referring first to FIG. 1 of the drawings, a keyboard musical instrument embodying the present invention largely comprises an acoustic piano 1 and an automatic playing system 2, and has a standard playing mode, a recording mode, a playback mode and a calibrating mode.

The acoustic piano 1 is a standard upright piano, and includes black and white keys 1*a* forming in combination a keyboard 1*b*, key action mechanisms 1*c* respectively connected to the black and white keys 1*b*, hammer assemblies 1*d* driven for rotation by the key action mechanisms 1*c*, respectively, sets of strings 1*e* struck by the hammer assemblies 1*d* and damper mechanisms 1*f* for preventing the strings 1*e* from vibrations. The set of strings 1*e* is sometimes called as "music string". The key action mechanism 1*c*, the hammer assembly 1*d* and the damper mechanism 1*f* are well known to a person skilled in the art, and no further description is incorporated hereinbelow for the sake of simplicity.

When the key 1*a* is downwardly depressed from the rest position toward the end position, the key action mechanism 1*c* slowly rotates the hammer assembly 1*d* from its rest position toward the set of strings 1*e*, and causes the damper mechanism 1*f* to space the damper head 1*f* from set of strings 1*e*. When the jack 1*h* is brought into contact with the regulating button 1*i*, the jack 1*h* quickly turns, and causes the hammer assembly 1*d* to escape from the jack 1*h*. The hammer assembly *d* starts a free rotation, and the hammer head 1*j* strikes the set of strings. The strings 1*e* vibrate for generating a tone, and the hammer head 1*j* rebounds on the strings 1*e*.

When the player releases the key, the key action mechanism 1*c* causes the hammer assembly 1*d* and the hammer butt 1*k* to return to the rest positions, and allows the damper mechanism 1*f* to bring the damper head 1*g* into contact with the strings 1*e* again. The damper head 1*g* restricts the vibrations of the strings 1*e*, and terminates the tone. The timing at which the damper head 1*g* is brought into contact with the strings 1*e* is hereinbelow referred to as "terminative timing".

When the hammer head 1*d* strikes the set of strings 1*e*, the hammer shank 1*m* reaches an impact point XE.

The automatic playing system 2 includes a plurality of solenoid-operated actuator units 2*a* mounted on a key bed 1*n* and associated with the black and white keys 1*a*, respectively. The solenoid-operated actuator unit 2*a* has a solenoid coil (not shown) housed in a solenoid case 2*b* and a plunger 2*c* protectable from the solenoid case 2*b*. When the solenoid coil is energized, the solenoid coil projects the plunger 2*c* from the solenoid case 2*b*, and moves the associated key 1*a* as if a player depressed. When driving current DR is removed, a return spring (not shown) retracts the plunger 2*c* into the solenoid case 2*b*, and the key 1*a* returns to the rest position as if the player releases the key 1*a*.

The automatic playing system 2 further includes a plurality of hammer sensors 2*d* associated with the hammer assemblies 1*d*, respectively, and the hammer sensor 2*d* is implemented by a pair of photo-interrupters 2*e*/2*f*. The first photo-interrupter 2e and the second photo-interrupter 2f are spaced apart from each other along the rotational path of the associated hammer assembly 1d, and the distance between the photo-interrupters 2e and 2f is adjusted to a predetermined value dXm. The first and second photo-interrupters 2e and 2f radiate light beams across the rotational path, and the hammer shank 1m intermittently intersects the light beam of the first photo-interrupter 2e and the light beam of the second photo-interrupter 2f after the escape from the jack 1h. The first and second photo-interrupters 2e/2f convert the light intensities to electric potentials, and, accordingly, the hammer sensor 2d generates a two-bit hammer position signal representative of a current hammer position. The second photo-interrupter 2f is positioned as close to the impact point XE as possible, and, for this reason, an impact timing is given at the intersection of the light beam of the second photo-interrupter 2f.

The automatic playing system 2 further includes a controlling unit 2g for the recording mode and the playback mode. A controller 2h for hammer sensors and a data processor 2i are incorporated in the controlling unit 2g, and the controller 2h are connected to the hammer sensors 2d. The controller measures the time interval between the intersection of the first photo-interrupter 2e and the intersection of the second photo-interrupter 2f, and calculates a forward hammer velocity VP from the rest position XR toward the impact point XE and a backward hammer velocity VN from the impact point XE toward the rest position XR. The controller 2h determines the impact timing at the intersection of the light beam of the second photo-interrupter 2f.

The automatic playing system 2 further includes key sensors 2j respectively associated with the black and white keys 1a, and the key sensor 2j has a shutter plate 2k attached to the bottom surface of the key 1a and a pair of photo-interrupters 2m arranged along a path of the shutter plate 2k. The two photo-interrupters 2m are spaced apart from each other by a predetermined distance. The photo-interrupters 2m radiate light beams across the path of the shutter plate 2k, and convert the light intensities to electric potentials. While the key 1a is traveling from the rest position to the end position, the shutter plate 2k interrupts the light beam of the upper photo-interrupter and, thereafter, the light beam of the lower photo-interrupter. The interruption varies the light intensity, and the key sensor 2j generates a two-bit key position signal KP representative of a current key position.

When the player releases the key 1a, the shutter plate 2k allows the lower photo-interrupter to bridge the light beam and, thereafter, the upper photo-interrupter to bridge the light beam.

The key position signals KP are supplied from the key sensors 2j to the controller 2h. The controller 2h measures a time interval from the recovery from the photo-interruption of the lower photo-interrupter to the recovery from the photo-interruption of the upper photo-interrupter, and calculates the backward key velocity from the end position toward the rest position. The controller 2h further determines the terminative timing upon the recovery from the photo-interruption of the upper photo-interrupter.

Thus, while a player is performing a music in a recording mode, the controller 2h calculates the forward hammer velocity for each depressed key and the backward key velocity for each released key, and determines the impact timing for each depressed key and the terminative timing for each released key.

The forward hammer velocity/the impact timing and the backward key velocity/terminative timing are reported to the data processor 2i. The data processor 2i is implemented by a microprocessor and associated registers, and generates music data codes representative of various event data. The event data represent key code information indicative of a depressed key 1a, key-on information indicative of the impact timing for the depressed key 1a, key-off information indicative of the terminative timing and key velocity information indicative of the forward hammer velocity of the depressed key 1a.

The automatic playing system 2 further includes a data storage unit 2n connected to the data processor 2i, and the data storage unit 2n stores the music data codes in the recording mode. The music data codes may be supplied from the data processor 2i to another electronic musical instrument 3 in a real time fashion.

The automatic playing system 2 further includes a playback unit 2o connected to the data storage unit 2n and a motion controller 2p connected to the playback unit 2o. The music data codes is supplied from the data storage unit 2n or the electric musical instrument 3 to the playback unit 2o, and the motion controller 2p controls the solenoid-operated actuator units 2a.

The play back unit 2o determines a motion of the key 1a to be actuated on the basis of the music data codes in the playback mode. The key 1a is moved at a velocity corresponding to the magnitude of the driving current DR, and the hammer velocity is controllable with the key velocity. Therefore, the motion controller 2p determines the magnitude of the driving current DR on the basis of the music data code representative of the forward hammer velocity VP, and forecasts the initiative timing. The motion controller 2p energizes the solenoid-operated actuator unit 2a associated with the key 1a to be depressed at the initiative timing, and controls the magnitude of the driving current DR. After the impact, the motion controller 2p decreases the driving current DR so as to maintain the key 1a at the end position, and removes the driving current DR from the solenoid coil at the terminative timing.

The behavior of the keyboard musical instrument in the standard playing mode, the recording mode and the playback mode is known to a person skilled in the art. For this reason, description is focused on the calibration mode.

Figure 2:
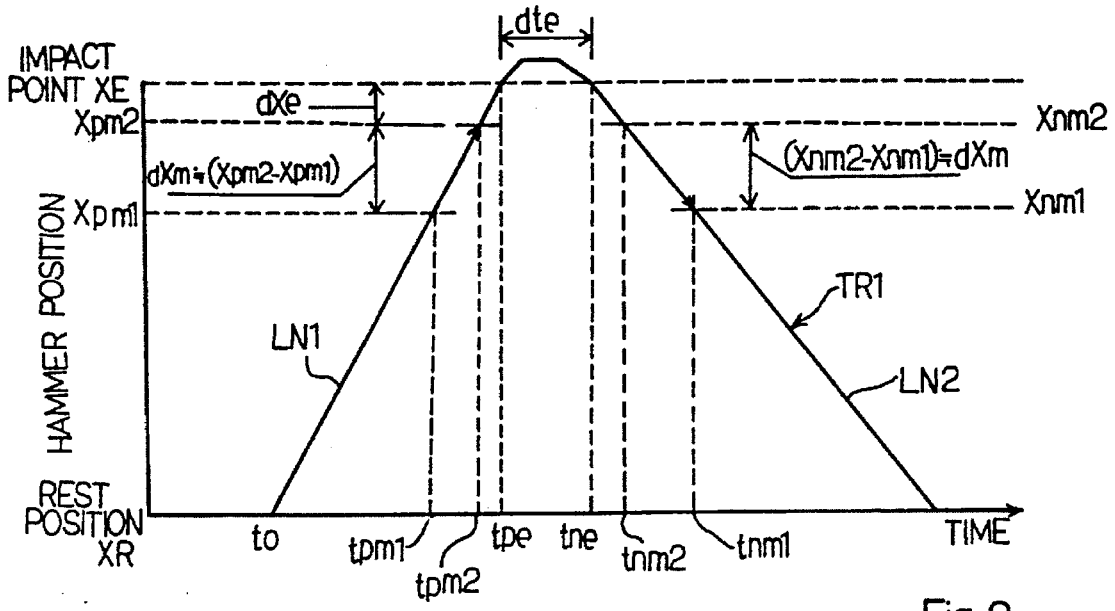
FIG. 2 is a diagram showing a trajectory of a hammer shank between a rest position and an impact point.

The controlling unit 2g calibrates the hammer sensors 2d. First, description is hereinbelow made on the principle of the calibration. FIG. 2 illustrates the trajectory TR1 of the hammer shank 1m from the rest position XR to the impact point XE. The hammer shank 1m is assumed to travel the path from the rest position XR to the impact position XE at a constant speed VP/VN, and the trajectory TR1 is represented by oblique linear lines.

Assuming now that the associated key 1a is depressed by a player, the hammer shank leaves the rest position XR at time t0, and intersects the light beam of the first photo-interrupter 2e at time tpm1 and the light beam of the second photo-interrupter 2f at time tpm2. The hammer head 1f is brought into contact with the strings 1e at time tpe, and leaves the strings 1e at time tne. The hammer head 1f is continuously held in contact with the strings between time tpe and time tne, and the time interval between time tpe an time tne is referred to as "contact time".

The hammer shank backwardly travels the path, and intersects the light beam of the second photo-interrupter 2f at time tnm2 and the light beam of the first photo-interrupter 2e at time tnm1. Therefore, the forward hammer velocity VP is given by equation 1.

$$VP=dXe/(tpe-tpm2) \quad \text{Equation 1}$$

where dXe is a distance from the intersection of the light beam of the second photo-interrupter 2f and the impact position against the strings 1e.

The hammer shank 1m is assumed to intersect the light beam of the first photo-interrupter 2e at point Xpm1 and the light beam of the second photo-interrupter 2f at point Xpm2 on the way from the rest position XR to the impact point XE. The difference between the points Xpm1 and Xpm2 is approximately equal to the distance dXm between the first photo-interrupter 2e and the second photo-interrupter 2f.

Similarly, the hammer shank 1m is assumed to intersect the light beam of the second photo-interrupter 2f at point Xnm2 and the light beam of the first photo-interrupter 2e at point Xnm1 on the way from the impact point XE to the rest position XR. The difference between the points Xnm2 and Xnm1 is approximately equal to the distance dXm. The backward hammer velocity VN is expressed by equation 2.

$$VN=(dXe+dXm)/(tnm1-tne) \qquad \text{Equation 2}$$

The forward hammer velocity VP and the backward hammer velocity VN are calculated by the controller 2h, and the distance dXe, the times tpe and tne are unknown. The contact time dte is expressed by equation 3.

$$dte=tne-tpe \qquad \text{Equation 3}$$

Figure 3:
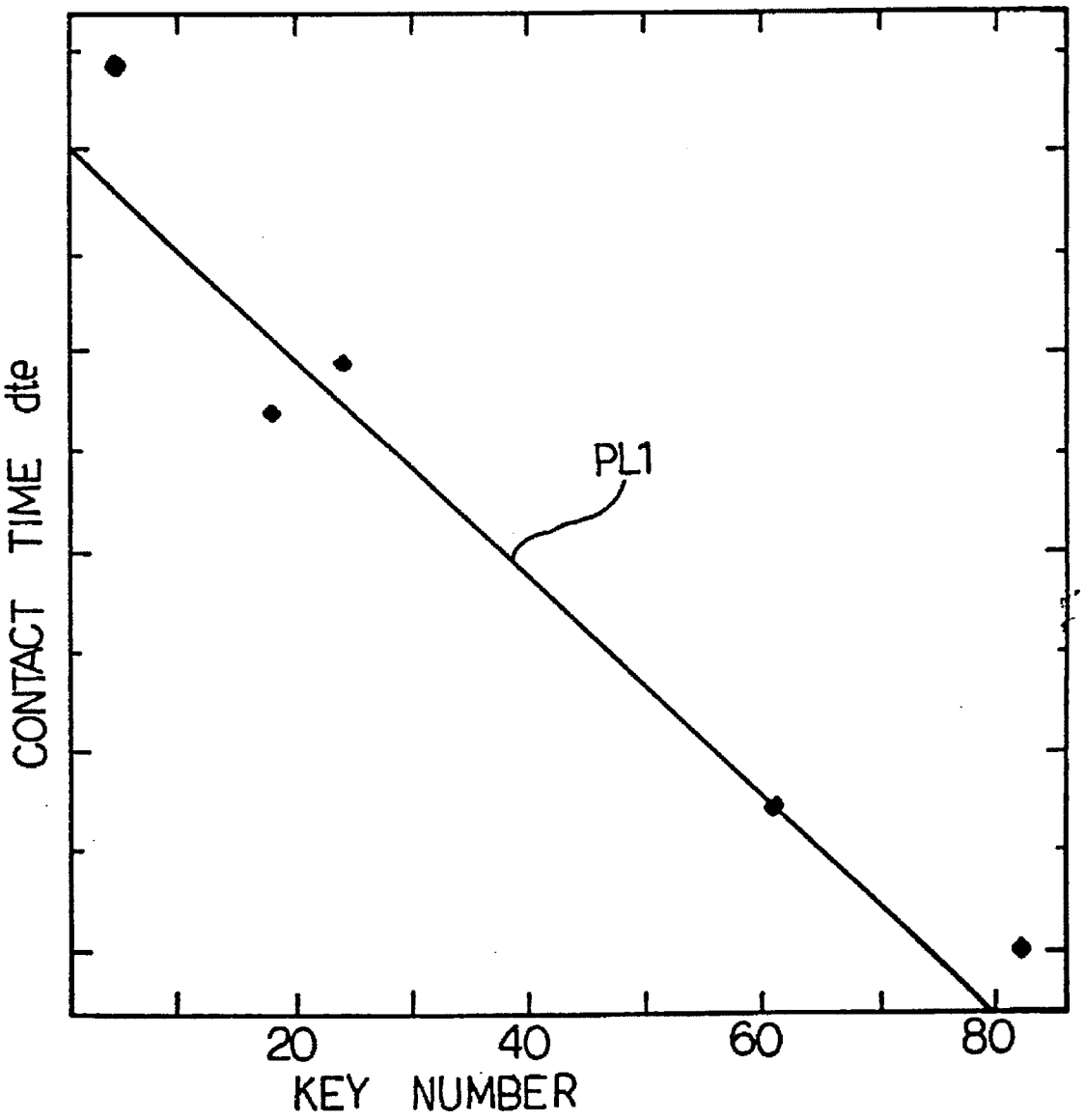
FIG. 3 is a graph showing relation between a contact time and a key number measured by the present inventors.

The present inventors found that the contact time dte was dependent on the key number assigned to every key 1a or the note of the tone generated by the key 1a. In detail, the present inventors measured the contact time dte at different hammer velocities VP; however, the hammer velocity VP did not affect contact time dte, and the contact time dte was plotted as shown in FIG. 3. When the key number was increased, the contact ime dte was decreased, and the plots were approximated by linear line PL1. The reason for the linearity was that the contact time dte was strongly affected by the vibration period of the strings 1e.

The contact time dte is expressed by equation 4.

$$dte=a\times k+b \qquad \text{Equation 4}$$

where k is the key number and a and b are constants. If a table defines the relation between the key number k and the contact time dte, the contact time dte is immediately read out from the table upon detection of a depressed key 1a.

When the contact time dte is given, times tne and tpe are eliminated by using equations 1 to 3, and equation 5 gives the distance dXe as follows.

$$\begin{aligned} dXe &= (tnm1-dXm/VN-tpm2-dte)/(1/VP+1/VN) \\ &= ((tnm1-tpm2-dte)VN-dXm)VP/(VP+VN) \end{aligned} \qquad \text{Equation 5}$$

Thus, the controller 2h calculates the distance dXe between the second photo-interrupter 2f and the impact point XE on the basis of the hammer position signal HP.

Turning back to FIG. 1 of the drawings, the automatic playing system 2 calibrates the hammer position signals HP through the calculation of the individual distances dXe as follows. While the automatic player piano is in the calibration mode, the controlling unit 2g is connected to a test data source 4 and a monitor display 5. The test data source 4 supplies test data codes to the playback unit 2o, and the data processor 2i makes the monitor display 5 to indicate the distances dXe and the key numbers on the screen 5a. The table for the contact time dte is stored in the data processor 2i. The test data codes may be stored in the data storage unit 2n in a non-volatile manner.

Figure 4:
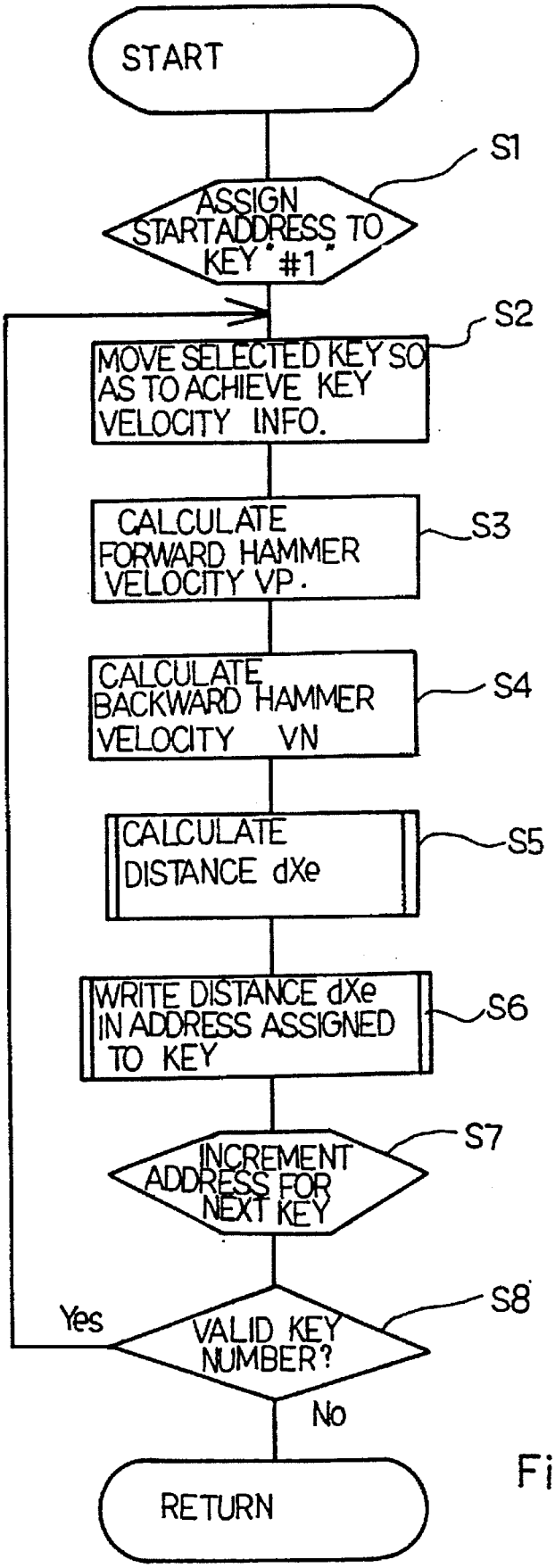
FIG. 4 is a flow chart showing a program sequence executed by a controlling unit in a playback mode.

FIG. 4 illustrates a flow chart executed in the calibration mode. The test data codes are supplied from the data storage unit 2n or the external test data source 4 to the controlling unit 2g. The test data codes are analogous to the music data codes and representative of the event data, i.e., the key code information, the key-on information, the key-off information and the key velocity information. The key code information sequentially specifies the black and white keys 1a.

When the playback unit 2o receives the first event data representative of the key code information "#1", the data processor 2i assigns a start address to the key "#1" as by step S1, and the playback unit 2o extracts the key velocity information from the event data. The playback unit 2o instructs the motion controller 2p to control the solenoid-operated actuator 2a associated with the key "#1" in such a manner as to move the hammer assembly 1d at the forward hammer velocity VP equivalent to the key velocity information as by step S2.

The solenoid-operated actuator 2a causes the key "#1" to turn as if a player depresses it. The associated key action mechanism 1c rotates the hammer assembly 1d, and the hammer assembly 1c starts the free rotation after the escape from the jack 1h. The hammer shank 1m intersects the light beam of the first photo-interrupter 2e at time tpm1 and the light beam of the second photo-interrupter 2f at time tpm2, and, accordingly, the hammer sensor 2d changes the two-bit hammer position signal at time tpm1 and time tpm2.

The controller 2h calculates the time interval (tpm2–tpm1 ) between the first intersection and the second intersection, and divides the distance dXm by the time interval (tpm2–tpm1). Thus, the forward hammer velocity VP is calculated by the controller 2h as by step S3.

The hammer head 1j strikes the associated set of strings 1e, and rebounds thereon. Although the hammer head 1j is held in contact with the set of strings 1e over the contact time dte, the hammer assembly returns toward the rest position XR, and intersects the light beam of the second photo-interrupter 2f at time tnm2 and the light beam of the first photo-interrupter 2e at time tnm1. The hammer sensor 2d twice changes the hammer position signal HP at times tnm2 and tnm1, and the controller 2h determines the time interval between tnm2 and tnm1. The controller 2h divides the distance dXm by the time interval (tnm2–tnm1), and determines the backward hammer velocity as by step S4.

The controller 2h transfers the times tpm1, tpm2, tnm2 and tnm1, the forward hammer velocity VP and the backward hammer velocity VN to the data processor 2i. The data processor 2i accesses the table defining the contact time dte and the key number, and reads out the contact time dte for the key "#1", and calculates the distance dXe by using equation 5. The data processor 2i supplies the distance dXe between the second photo-interrupter 2f and the set of strings 1e associated with the key "#1" to the start address of the data storage unit 2n as by step S6, and the distance dXe1 is written into the start address.

Subsequently, the data processor 2i increments the address in the data storage unit 2n as by step S7, and checks the address to see whether or not the next key number is valid as by step S8. While the answer at step S8 is given affirmative the data processor 2i, the playback unit 20, the motion controller 2p and the controller 2h repeat the loop consisting of steps S2 and S8, and stores the distance dxe into the address assigned to the given key number.

Finally, when the distance dXe88 is stored in the data storage unit 2n, the answer at step S8 is given negative. Then, the data processor 2i displays the distance dXe for each key 1*a* on the screen 5*a*, and completes the program sequence for the calibration mode.

Using the table for the distance dXe, a tuning worker adjusts each of the second photo-interrupters 2*f* to a target position.

In this instance, the hammer sensors 2*d* and the controlling unit 2*g* executing the program sequence shown in FIG. 4 as a whole constitute a distance measuring means.

Figure 5:
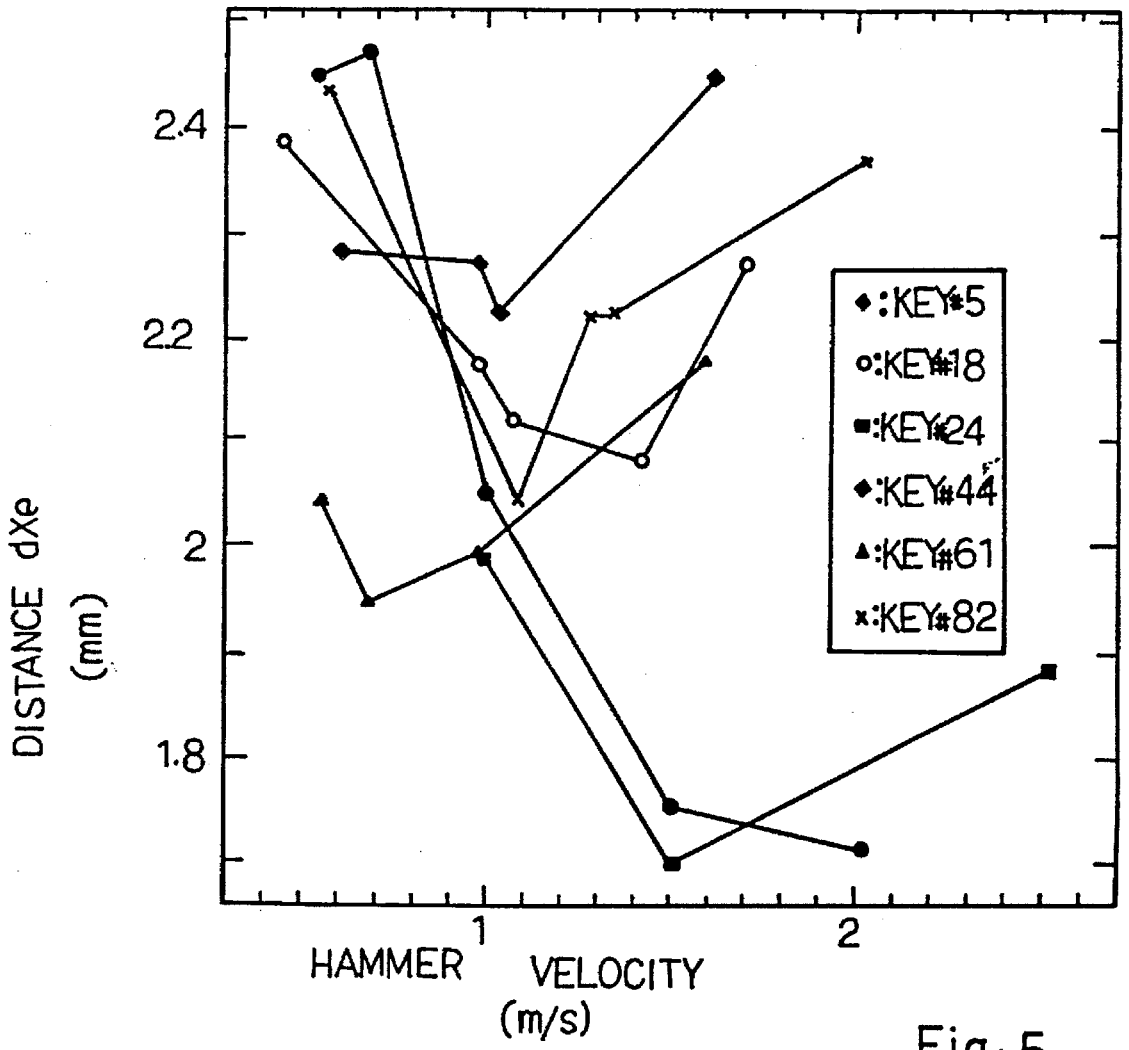
FIG. 5 is a graph showing relation between the hammer velocity and a distance between a second photo-interrupter and an impact point.

The present inventors evaluated the distance measuring means, and the distance dXe was plotted in FIG. 5 . Although the distance dXe fluctuates in dependence with the hammer velocity, the fluctuation fell within an allowable range, and the present inventors confirmed the validity of the distance dXe.

As will be appreciated from the foregoing description, the distance measuring means is implemented by the hammer sensors 2*d* and the controlling unit 2*g*, which are indispensable for the automatic player piano, and a tuning worker is only expected to adjust the second photo-interrupters 2*f* to the target positions in consideration of the distances dXe displayed on the screen 5*a*. Therefore, the tuning work is simple and easy . Moreover, no additional hardware is required for the calibration, and the distance measuring means according to the present invention is economical.

Second Embodiment

Another automatic player piano embodying the present invention is similar in structure to the first embodiment, and FIG. 1 is referred to in the following description.

Figure 6:
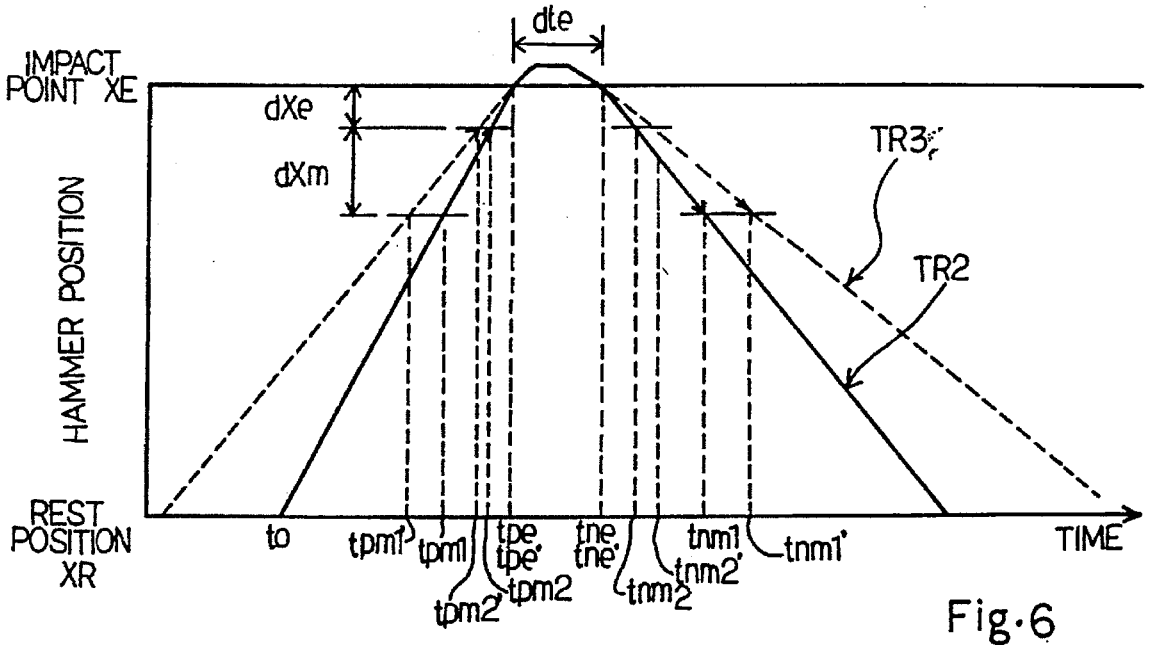
FIG. 6 is a diagram showing a trajectory of another hammer shank between a rest position and an impact point.

A method of calculating the distance dXe is different from that of the first embodiment. In detail, the automatic player piano implementing the second embodiment causes the solenoid-operated actuator unit 2*a* to move the associated key twice, and FIG. 6 illustrates the trajectories of the hammer assembly 2*d*. Real line TR2 and broken line TR3 are representative of the trajectory of the hammer assembly 2*d* during the first motion and the trajectory of the same hammer assembly 2*d* during the second motion. The trajectory TR2 is identical with the trajectory TR1, and the timings are labeled with the same references as those used in FIG. 2.

While the hammer assembly 2*d* is traveling along the second trajectory TR3, the hammer shank 1*m* intersects the light beam of the first photo-interrupter 2*e* at the tpm1' and the light beam of the second photo-interrupter 2*f* at time tpm2' on the way from the rest position XR toward the impact point XE. The hammer head 1*j* is brought into contact with the set of strings 1*e* at time tpe', and is held in contact with the strings 1*e* between time tpe' and time tne'. The hammer shank 1*m* intersects the light beam of the second photo-interrupter 2*f* at time tnm2' and the light beam of the first photo-interrupter 2*e* at time tnm1' on the way from the impact point XE toward the rest position XR.

The forward hammer velocity VP' and the backward hammer velocity VN' in the second hammer motion are given by equations 6 and 7.

$$VP'=dXe/(tpe'-tpm2') \quad \text{Equation 6}$$

$$VN'=(dXe+dXm)/(tnm1'-tne') \quad \text{Equation 7}$$

The time interval between time tne' and time tpe' is equal to the contact time dte as expressed by equation 8.

$$dte=tne'-tpe' \quad \text{Equation 8}$$

From equations 6 to 8 and equations 1 to 3, the distance dXe is given by equation 9.

$$dXe=(tnm1'-tnm1-dXm(1/VN'-1/VN)-tpm2'+tpm2)/(1/VP'-1/VP+1/VN'-1/VN) \quad \text{Equation 9}$$

Therefore, the controlling unit 2*g* of the second embodiment calculates the distance dXe by using equation 9. However, the test data codes contain a first piece of key velocity information indicative of the first hammer motion and a second piece of key velocity information indicative of the second hammer motion for each key 1*a*, and the second hammer motion is different in hammer velocity from the first hammer motion.

The automatic player piano implementing the second embodiment achieves all the advantages of the first embodiment. The table for the contact time or the calculation of equation 4 is unnecessary for the second embodiment.

Third Embodiment

Yet another automatic player piano embodying the present invention is similar in structure to the first embodiment, and FIGS. 1 and 2 are referred to in the following description again.

The second photo-interrupter 2*f* is spaced from the impact point XE by the distance dXe, and the distance dXe introduces delay dXe/VP between the intersecting time tpm2 and the impact time tpe on the assumption that the hammer assembly 1*d* continues the uniform motion.

In the first and second embodiments, the hammer head 1*j* is assumed to strike the strings 1*e* at the intersecting time tpm2, and the data processor 2*i* generates the music data code representative of the key-on information on the basis of the intersecting time tpm2. On the other hand, the data processor 2*i* of the third embodiment generates the music data code representative of the key-on information on the basis of the impact time tpe delayed from the intersecting time tpm2 by dXe/VP as follows.

$$tpe(k)=tpm2+dXe(k)/VP \quad \text{Equation 10}$$

where (k) is indicative of the key number and tpe(k) and dXe(k) are the impact time and the actual distance for the key "#k". The actual distance dXe(k) is calculated by using equation 5 or equation 9.

The data processor 2*i* carries out a normalization on the impact time tpe(k) and other event data before transmission of the music data codes to the data storage unit 2*n*, and the normalization eliminates the individuality of the acoustic piano 1 from the event data.

Description is hereinbelow made on a recording mode of the automatic player piano implementing the third embodiment. While a player is playing the acoustic piano 1, the hammer sensors 2*d* change the hammer position signals HP. The controller 2*h* determines the motions of the hammer assemblies 1*d* associated with the depressed keys 1*a*, and the data processor 2*i* determines the actual distance dXe(k). The data processor 2*i* calculates the impact time tpe(k) as described hereinbefore. The data processor 2*i* normalizes the event data, and formats them into music data codes. The music data codes are transferred to the data storage unit 2*n*, and stored therein. The data storage unit 2*n* may be a floppy disk driver, and the music data codes are stored in a floppy disk.

While the music performance is being reproduced in the playback mode, the hammer heads 1*j* sequentially strike the sets of strings 1*e* at time intervals, and the time intervals are equal to the intervals of the impact times tpe(k). Therefore, even if the hammer sensors 2*d* are deviated from the appropriate positions, the automatic player piano faithfully reproduces the music performance.

Thus, the controlling unit 2g automatically corrects the deviations of the hammer sensors 2d, and the workers are not expected to exactly position the of the hammer sensors 2d at the appropriate positions. Moreover, even if a music performance is reproduced by the automatic player piano different from a recording instrument, the automatic player piano can correct errors of the impact times tpe(k) due to the difference in the actual distance dXe between the recording instrument and the automatic player piano.

Fourth Embodiment

Still another automatic player piano embodying the present invention is similar to the third embodiment, and the references in FIG. 1 are used in the following description. Although the third embodiment forecasts the impact time tpe(k) on the assumption that the hammer assembly 2d continues the uniform motion, the automatic player piano implementing the fourth embodiment assumes the hammer assembly 2d to be decelerated due to the gravity, and forecasts the impact time tpe(k) on this assumption.

Linear line LN1 is representative of the hammer motion intersecting the light beam of the first photo-interrupter 2e at time tpm1 and the light beam of the second photo-interrupter 2f at time tpm2. The hammer assembly 2d represented by linear line LN1 strikes the strings 2e at the impact time tpe. Let's assume a rectangular coordinate system X-t having the origin "O" at (tpm1+tpm2)/2. The automatic player piano implementing the fourth embodiment assumes the hammer head to trace a linear line until the intersecting point tpm1 and, thereafter, a parabola PB passing through the origin "O". The parabola PB is expressed by equation 11.

$$X=(-g\ t^2)/2+VP\ t \qquad \text{Equation 11}$$

where VP is the average hammer velocity between the first intersecting point Xpm1 and the second intersecting point Xpm2. The hammer head 1j strikes the strings 1e at point D in the rectangular coordinate system X-t. The point D has X-coordinate "dtpe".

$$dXm/2+dXe=-g\ dtpe^2/2+VP\ dtpe \qquad \text{Equation 12}$$

The parabola PB reaches the impact point XE at corrected impact time tpe', and dtpe is expressed as $$dtpe=(tpe'-(tpm1+tpm2)/2) \qquad \text{Equation 13}$$

From equations 12 and 13, we obtain equation 14.

$$dXm/2+dXe=-g\ tpe'^2/2+(g(tpm1+tpm2)/2+VP)tpe'-g/2((tpm1+tpm2)/2)^2-VP(tpm1+tpm2)/2 \qquad \text{Equation 14}$$

Figure 7:
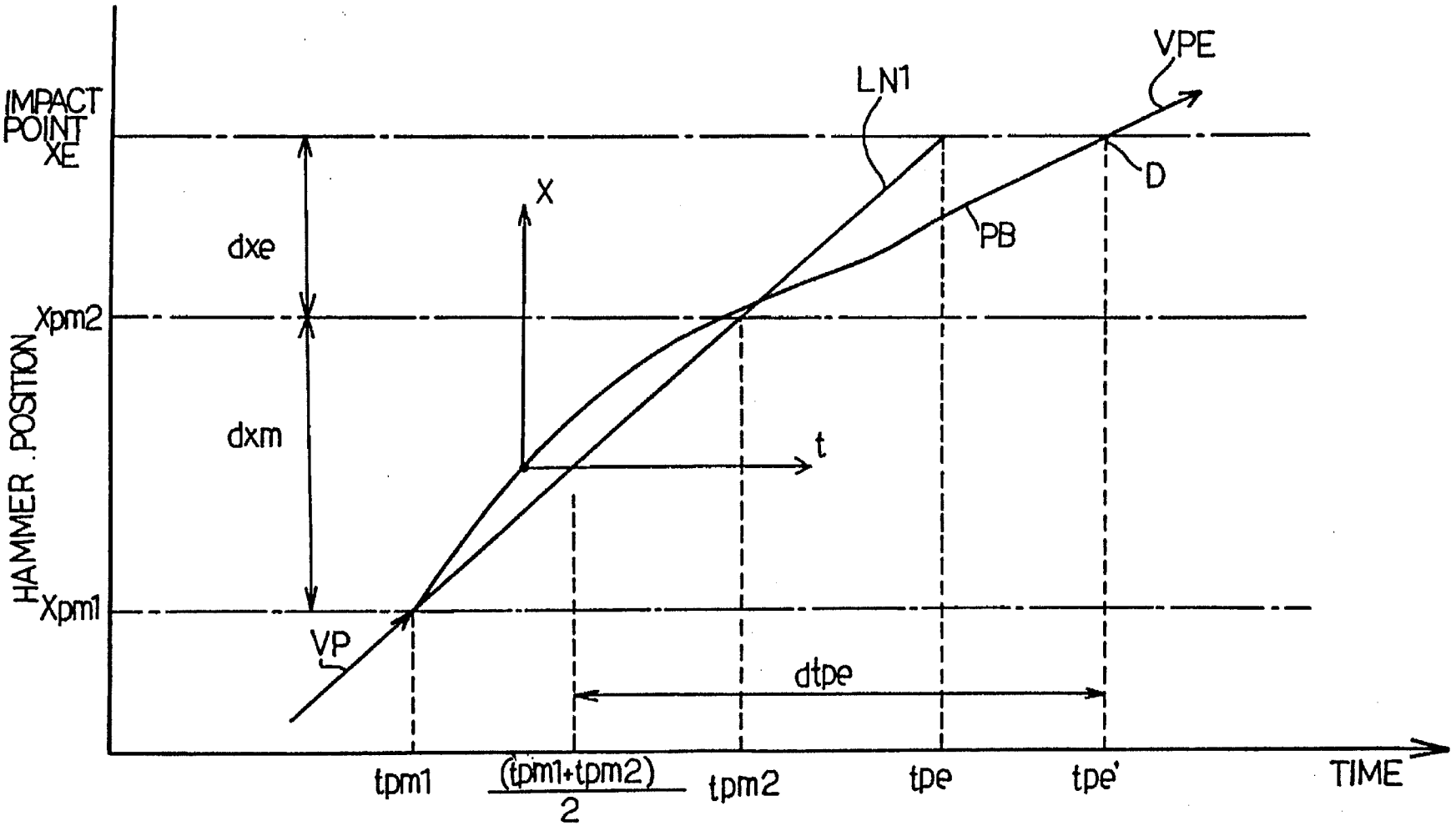
FIG. 7 is a graph showing a trajectory of yet another hammer shank.

Equation 14 is a quadratic equation for the corrected impact time "tpe'". Therefore, the corrected impact time tpe' is given by equation 15.

$$\begin{aligned} tpe' &= (VP-\mathrm{sqrt}(VP^2-g(dXm+2\,dXe)))/g+(tpm1+tpm2)/2 \\ &= (VP-\mathrm{sqrt}(VP^2-g(dXm+2\,dXe)))/g+tpm2-dXm/2\ VP \\ &= (VP-\mathrm{sqrt}(VP^2-g(dXm+2\,dXe)))/g+tpe-(dXm+2dXe)/2\ VP \end{aligned} \qquad \text{Equation 15}$$

where "sqrt" is representative of the square root sign and tpe is the impact time given by equation 10. Although the corrected impact time tpe' has two values, it is understood from FIG. 7 that the smaller value is appropriate for the corrected impact time tpe', and equation 15 gives the smaller value. When the average hammer velocity VP is too small, the hammer head 1j does not reach the strings 1e, and the square root gives a negative value. In this case, the value of the square root is assumed to be zero.

The hammer velocity V on the parabola PB is given by equation 16.

$$V=-g\times t+VP \qquad \text{Equation 16}$$

The hammer velocity VPE at the corrected impact point tpe' is given by equation 17.

$$\begin{aligned} VPE &= -g\times dtpe+VP \\ &= -g(tpe'-(tpm1+tpm2)/2)+VP \\ &= \mathrm{sqrt}\,(VP^2-g(dXm+2\,dXe)) \end{aligned} \qquad \text{Equation 17}$$

Figure 8:
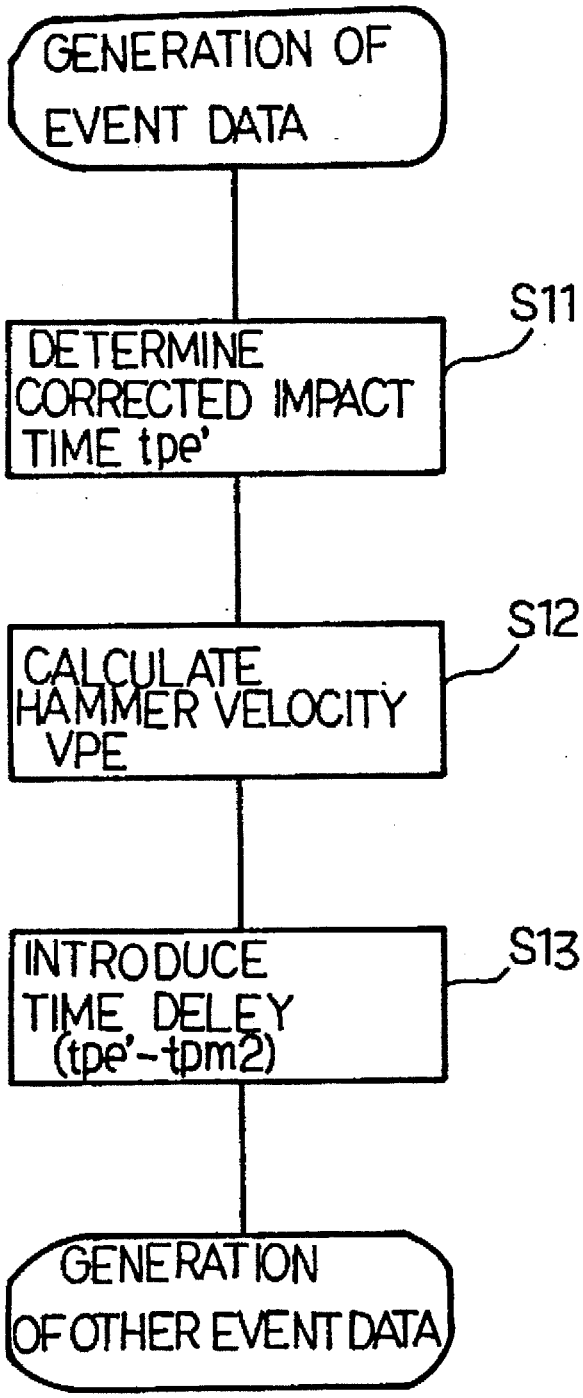
FIG. 8 is a flow chart showing a program sequence executed by a controlling unit incorporated in an automatic player piano in a recording mode.

The automatic player piano thus arranged behaves in the recording mode as follows. FIG. 8 illustrates a program sequence executed by the controlling unit 2g in the recording mode, and music data codes are supplied to an external musical instrument in the real time fashion.

When a player depresses one of the keys 1a, the controller 2h determines the intersecting times tpm1 and tpm2, and calculates the forward hammer velocity VP. The forward hammer velocity VP, the intersecting point tpm2 and the key number assigned to the depressed key 1a form the event data, and the event data are supplied to the data processor 2i. The data processor 2i determines the actual distance dxe by using equation 5 or equation 9 and, thereafter, the corrected impact time tpe' by using equation 15 as by step S11.

Subsequently, the data processor 2i calculates the hammer velocity VPE as by step S12, and formats the event data into a music data code after the normalization. The data processor 2i retards the output of the music data code representative of the event data by a time interval (tpe'−tpm2) as by step S13, and the music data code is supplied to the external musical instrument.

When the player releases the key 1a, the key 1a returns to the rest position, and the key sensor 2j reports the key motion to the controller 2h. The controller 2h determines the backward key velocity and the terminative time, and the data processor 2i formats these event data into a music data code.

The automatic player piano implementing the fourth embodiment achieves all the advantages of the third embodiment. Another attractive point of the fourth embodiment is derived from the assumption, i.e, the hammer assembly 2d traces a parabola after the intersection of the first photo-interrupter 2e. If the second intersecting time tpm1 is assumed to be the impact time tpe, the key touch or the force exerted on the key 1a varies a time difference between the times tpm2 and tpe. However, the parabola changes the corrected impact time tpe' depending upon the hammer velocity VP variable with the key touch. Therefore, the automatic player piano is free from the undesirable time difference.

Fifth Embodiment

An automatic player piano implementing the fifth embodiment determines the corrected impact time tpe' and the hammer velocity VPE during the reproduction of a music performance. However, the structure is similar to the first embodiment, and members and electronic units of the fifth embodiment are labeled with the references used in FIG. 1 in the following description.

While the controlling unit 2g is recording a music performance, the intersecting time tpm2 and the hammer velocity between the first and second photo-interrupters 2e and 2f are assumed to be the impact time tpe and the hammer velocity at the impact time, and the data processor 2i uses the intersecting time tpm2 and the hammer velocity at the impact time as the event data. The event data are formatted into music data codes, and a set of music data codes is representative of the music performance.

The set of music data codes are supplied to the controlling unit 2g in the playback mode. The data processor 2i calculates the impact time tpe or the corrected impact time tpe' and the hammer velocity at the impact time/corrected impact time, and supplies the corrected music data codes to the playback unit 2o.

NORMALIZATION

As described hereinbefore, the automatic player pianos according to the present invention normalize the event data. The normalization eliminates the individuality of a recording instrument from the event data. For this reason, even if a music performance is reproduced by an automatic player piano different from the recording instrument, the automatic player piano can exactly reproduce the music performance.

The normalization is carried out as follows. A hammer assembly of a standard model is assumed to have an average mass m0. If the key strikes a string at a hammer velocity VP', an impact energy E is given by equation 18.

$$E=m0\times VP'^2/2 \qquad \text{Equation 18}$$

Another model is expressed with "n", and the hammer assembly "n" of the mode "n" has an average mass m(n). The hammer assembly "n" strikes the string at hammer velocity VP, and the impact energy E(n) of the hammer assembly "n" is assumed to be equal to the impact energy E. Equation 19 is given.

$$m(n)\ VP^2/2=m0\ VP'^2/2 \qquad \text{Equation 19}$$

The hammer velocity VP' is expressed by equation 20.

$$VP'=VP\ sqrt(m(n)/m0) \qquad \text{Equation 20}$$

Equation 20 normalizes the hammer velocity depending upon the average mass. When a small piano is used for recording a music performance, equation 20 normalizes the hammer velocity in the music performance, and the hammer velocity becomes smaller. If the music performance is reproduced by using the standard model, the small hammer velocity results in a soft impact, and the reproduced tone is close to the original tone.

In general, when the key number is increased, the mass of the associated hammer assembly is decreased. The key assigned the key number #40 represents the keyboard, and the hammer assembly associated with key "#40" has the average mass. The key number #40 is corresponding to #60 in a MIDI (Musical Instrument Digital Interface) tone generator. Even if the hammer velocity is equal, the impact energy is different depending upon the key number, and, accordingly, varies the loudness. Therefore, it is desirable to increase the hammer velocity together with the mass of the hammer assembly and decrease the hammer velocity for the small hammer assembly.

In detail, if the hammer assembly of key "#40" has the average mass m40, the impact energy E at the hammer velocity VP' is expressed by equation 21.

$$E=m40\ VP'^2/2 \qquad \text{Equation 21}$$

A key "k" in the same keyboard is associated with a hammer assembly "k", and the mass m of the hammer assembly "k" is given by equation 22.

$$m=\text{alpha}\ (k-40)+m40 \qquad \text{Equation 22}$$

where alpha is a constant. The hammer assembly "k" strikes a string at hammer velocity VP under the impact energy E, and we obtain equation 23.

$$m40\ VP'^2/2=(\text{alpha}(k-40)+m40)\ VP^2/2 \qquad \text{Equation 23}$$

Equation 23 is modified into equation 24.

$$VP'=VP\ sqrt(\text{alpha}(k-40)/m40+1)) \qquad \text{Equation 24}$$

Even if a music is performed on the automatic player piano different in mass of hammer assembly, the hammer velocity is normalized by using equation 24 as if all the hammer assemblies are equal in mass.

When the music performance is reproduced on the basis of the normalized event data, the hammer velocity may be modified in consideration of the actual mass of the hammer assembly. If the actual masses ma of the hammer assemblies are memorized in the playback unit 2o, the hammer velocity VP is modified by using equation 25, and the driving current DR is controlled with the modified hammer velocity.

$$VP'=VP\ sqrt(m40/ma) \qquad \text{Equation 25}$$

When a music performance is reproduced by the same automatic player piano, the impact times/corrected impact times are available for the reproduction.

As will be appreciated from the foregoing description, the controlling unit normalizes the event data, and the music data codes representative of the event data are available for another automatic player piano.

Although particular embodiments of the present invention have been shown and described, it will be obvious to those skilled in the art that various changes and modifications may be made without departing from the spirit and scope of the present invention.

For example, the distance measuring means according to the present invention may be incorporated in a keyboard musical instrument disclosed in U.S. Pat. No. 5,374,775 or a combination of the automatic player piano and the keyboard musical instrument disclosed in the U.S. Patent.

The target positions may be given to the data processor 2i so as to display differences between the actual distances dXe and the target positions.

In the above embodiments, the solenoid-operated actuators move the associated keys during the distance measurement. However, a tuning worker may sequentially depress the keys.

The first and second photo-interrupters may monitor the motion of a catcher.

In the above embodiments, the first photo-interrupter is integral with the second-photo-interrupter. However, the first photo-interrupters may be separated from the second photo-interrupters.

What is claimed is:

1. A keyboard musical instrument comprising:

an acoustic piano including a plurality of keys independently turnable on a stationary board member, a plurality of strings for generating tones through vibrations thereof, respectively, a plurality of hammer assemblies rotatable from respective rest positions for striking said plurality of strings at respective impact points, and a plurality of key action mechanisms respectively associated with said plurality of keys and respectively connected between said plurality of keys and said plurality of hammer assemblies for rotating said plurality of hammer assemblies when said plurality of keys are selectively moved;

a plurality of hammer sensor units respectively associated with said plurality of hammer assemblies for monitoring the motions of said plurality of hammer assemblies, and each of said plurality of hammer sensor units including at least one first sensor provided at a first position and a second sensor provided at a second position closer to said impact point than said first position so as to change a hammer position signal when the associated hammer assembly passes through said first position and said second position;

a controlling unit connected to said plurality of hammer sensor units for producing a set of music data codes representative of a music performance from said hammer position signals; and a distance measuring means including said plurality of hammer sensor units and said controlling unit, and determining an actual distance between said second position and said impact point for each of said plurality of hammer sensor units on the basis of changes of the hammer position signal supplied from said each of said plurality of hammer position units.

2. The keyboard musical instrument as set forth in claim 1, in which said distance measuring means determines a distance between said first position and said second position, a first timing of an intersection at said second position on the way from said rest position to said impact point, a second timing of an intersection at said first position on the way from said impact point to said rest position, a forward hammer velocity on the way from said first position to said second position, a backward velocity on the way from said second position to said first position and a contact time when one of said plurality of hammer assemblies is held in contact with the associated string after a strike thereagainst on the basis of said changes of the hammer position signal for determining said actual distance.

3. The keyboard musical instrument as set forth in claim 1, in which each of said plurality of hammer assemblies is twice rotated along a first trajectory and a second trajectory different in hammer velocity in a distance measurement, and said distance measuring means determines a distance between said first position and said second position, a first timing of an intersection at said second position on the way from said rest position to said impact point along said first trajectory, a second timing of an intersection at said first position on the way from said impact point to said rest position along said first trajectory, a third timing of an intersection at said second position on the way from said rest position to said impact point along said second trajectory, a fourth timing of an intersection at said first position on the way from said impact point to said rest position along said second trajectory, a first forward hammer velocity on the way from said first position to said second position along said first trajectory, a first backward hammer velocity on the way from said second position to said first position along said first trajectory, a second forward hammer velocity on the way from said first position to said second position along said second trajectory and a second backward hammer velocity on the way from said second position to said first position along said second trajectory on the basis of said changes of said hammer position signal for determining said actual distance.

4. The keyboard musical instrument as set forth in claim 1, further comprising a plurality of solenoid-operated actuator units respectively associated with said plurality of keys and selectively energized by said controlling unit on the basis of said set of music data codes for moving the associated ones of said plurality of keys.

5. A keyboard musical instrument comprising:

an acoustic piano including a plurality of keys independently turnable on a stationary board member, a plurality of strings for generating tones through vibrations thereof, respectively, a plurality of hammer assemblies rotatable from respective rest positions for striking said plurality of strings at respective impact points, and a plurality of key action mechanisms respectively associated with said plurality of keys and respectively connected between said plurality of keys and said plurality of hammer assemblies for rotating said plurality of hammer assemblies when said plurality of keys are selectively moved;

a plurality of hammer sensor units respectively associated with said plurality of hammer assemblies for monitoring the motions of said plurality of hammer assemblies, and each of said plurality of hammer sensor units including at least one first sensor provided at a first position and a second sensor provided at a second position closer to said impact point than said first position so as to change a hammer position signal when the associated hammer assembly passes through said first position and said second position;

a controlling unit connected to said plurality of hammer sensor units for producing a set of music data codes representative of a music performance from said hammer position signals, said set of music data codes containing pieces of key-code information each indicative of one of said plurality of keys depressed or released, pieces of key velocity information each indicative of a hammer velocity between said first position and said second position and pieces of impact time information each indicative of an impact time at which an associated one of said plurality of hammer assemblies strikes the associated string; and a distance measuring means including said plurality of hammer sensors and said controlling unit, and determining an actual distance between said second position to said impact point for each of said plurality of hammer sensor units on the basis of changes of the hammer position signal supplied from said each of said plurality of hammer position units, said controlling unit delaying a first time intersecting said second position by a second time calculated on the basis of said actual distance and a hammer velocity between said second position and said impact point for determining said impact time.

6. The keyboard musical instrument as set forth in claim 5, in which said distance measuring means determines a distance between said first position and said second position, a first timing of an intersection at said second position on the way from said rest position to said impact point, a second timing of an intersection at said first position on the way from said impact point to said rest position, a forward hammer velocity on the way from said first position to said second position, a backward velocity on the way from said second position to said first position and a contact time when one of said plurality of hammer assemblies is held in contact with the associated string after a strike thereagainst on the basis of said changes of the hammer position signal for determining said actual distance.

7. The keyboard musical instrument as set forth in claim 5, in which each of said plurality of hammer assemblies is twice rotated along a first trajectory and a second trajectory different in hammer velocity in a distance measurement, and said distance measuring means determines a distance between said first position and said second position, a first timing of an intersection at said second position on the way from said rest position to said impact point along said first trajectory, a second timing of an intersection at said first position on the way from said impact point to said rest position along said first trajectory, a third timing of an intersection at said second position on the way from said rest position to said impact point along said second trajectory, a fourth timing of an intersection at said first position on the way from said impact point to said rest position along said second trajectory, a first forward hammer velocity on the way from said first position to said second position along said first trajectory, a first backward hammer velocity on the way from said second position to said first position along said first trajectory, a second forward hammer velocity on the way from said first position to said second position along said second trajectory and a second backward hammer velocity on the way from said second position to said first position along said second trajectory on the basis of said changes of said hammer position signal for determining said actual distance.

8. The keyboard musical instrument as set forth in claim 5, further comprising a plurality of solenoid-operated actuator units respectively associated with said plurality of keys and selectively energized by said controlling unit on the basis of said set of music data codes for moving the associated ones of said plurality of keys.

9. The keyboard musical instrument as set forth in claim 5, in which said hammer velocity between said second position and said impact point is estimated on the assumption that said hammer assembly continues a uniform motion after an intersection at said second position.

10. The keyboard musical instrument as set forth in claim 5, in which said hammer velocity between said second position and said impact point is estimated on the assumption that the gravity decelerates said hammer assembly.

* * * * *